US009348271B2

(12) United States Patent
Kato et al.

(10) Patent No.: US 9,348,271 B2
(45) Date of Patent: May 24, 2016

(54) TRANSFER DEVICE AND IMAGE FORMING APPARATUS INCLUDING SAME

(71) Applicants: Yuji Kato, Kanagawa (JP); Shinya Tanaka, Kanagawa (JP)

(72) Inventors: Yuji Kato, Kanagawa (JP); Shinya Tanaka, Kanagawa (JP)

(73) Assignee: Ricoh Company, Ltd., Tokyo (JP)

( * ) Notice: Subject to any disclaimer, the term of this patent is extended or adjusted under 35 U.S.C. 154(b) by 0 days.

(21) Appl. No.: 14/712,204

(22) Filed: May 14, 2015

(65) Prior Publication Data

US 2015/0346650 A1 Dec. 3, 2015

(30) Foreign Application Priority Data

May 27, 2014 (JP) ..... 2014-109435

(51) Int. Cl.
*G03G 15/16* (2006.01)
*G03G 15/01* (2006.01)

(52) U.S. Cl.
CPC ..... *G03G 15/1665* (2013.01); *G03G 15/0136* (2013.01); *G03G 15/1675* (2013.01)

(58) Field of Classification Search
CPC ..... G03G 15/1665; G03G 15/1675; G03G 15/0136
See application file for complete search history.

(56) References Cited

U.S. PATENT DOCUMENTS

2011/0158690 A1* 6/2011 Mimbu ..... G03G 15/1605 399/121
2012/0008991 A1* 1/2012 Shimizu ..... G03G 15/1675 399/297
2012/0213536 A1* 8/2012 Takeuchi ..... G03G 15/1605 399/45
2012/0230715 A1 9/2012 Ogino et al.
2012/0237234 A1 9/2012 Sugimoto et al.
2012/0328314 A1 12/2012 Sugimoto et al.
2012/0328321 A1 12/2012 Takeuchi et al.
2013/0064559 A1 3/2013 Nakamura et al.
2013/0089363 A1 4/2013 Mimbu et al.
2013/0121714 A1 5/2013 Tanaka et al.
2013/0136468 A1 5/2013 Shimizu et al.
2013/0136477 A1 5/2013 Ogiyama et al.
2013/0142531 A1 6/2013 Sugimoto et al.
2013/0148993 A1 6/2013 Aoki et al.

(Continued)

FOREIGN PATENT DOCUMENTS

JP 9-146381 6/1997

OTHER PUBLICATIONS

U.S. Appl. No. 14/594,531, filed Jan. 12, 2015.

*Primary Examiner* — Clayton E Laballe
*Assistant Examiner* — Victor Verbitsky
(74) *Attorney, Agent, or Firm* — Oblon, McClelland, Maier & Neustadt, L.L.P.

(57) ABSTRACT

A transfer device includes an image bearer to bear a toner image, a nip forming device to contact the image bearer to form a transfer nip, a transfer bias power source including a direct current (DC) power source and an alternating current (AC) power source electrically connected to each other to output a transfer bias including at least one of a DC bias and a superimposed bias to transfer the toner image from the image bearer onto a recording medium interposed in the transfer nip, a contact-and-separation device to cause the image bearer and the nip forming device to contact and separate from each other, and a controller to control the contact-and-separation device to increase a size of a space between the image bearer and the nip forming device upon transfer using the superimposed bias such that the space is larger than the space upon transfer using the DC bias.

9 Claims, 10 Drawing Sheets

(56) References Cited

U.S. PATENT DOCUMENTS

| | | | |
|---|---|---|---|
| 2013/0164011 | A1 | 6/2013 | Nakamura et al. |
| 2013/0177329 | A1 | 7/2013 | Tanaka et al. |
| 2013/0182269 | A1 | 7/2013 | Tanaka |
| 2013/0195483 | A1 | 8/2013 | Shimizu et al. |
| 2013/0216281 | A1 | 8/2013 | Suzuki et al. |
| 2013/0236201 | A1 | 9/2013 | Mizutani et al. |
| 2013/0243482 | A1 | 9/2013 | Kato et al. |
| 2013/0308968 | A1 | 11/2013 | Tanaka et al. |
| 2014/0010562 | A1 | 1/2014 | Tanaka et al. |
| 2014/0029988 | A1 | 1/2014 | Shimizu et al. |
| 2014/0072340 | A1 | 3/2014 | Kato et al. |
| 2014/0079418 | A1 | 3/2014 | Tanaka et al. |
| 2014/0169817 | A1 | 6/2014 | Sugimoto et al. |
| 2014/0219691 | A1 | 8/2014 | Ichikawa et al. |
| 2014/0248064 | A1 | 9/2014 | Tanaka et al. |
| 2014/0270830 | A1 | 9/2014 | Nakamura et al. |
| 2014/0314435 | A1 | 10/2014 | Kato et al. |
| 2014/0328603 | A1 | 11/2014 | Mizutani et al. |
| 2014/0328604 | A1 | 11/2014 | Tanaka et al. |
| 2014/0334847 | A1 | 11/2014 | Takahashi et al. |

* cited by examiner

TRANSFER DEVICE AND IMAGE FORMING APPARATUS INCLUDING SAME

CROSS-REFERENCE TO RELATED APPLICATIONS

This patent application is based on and claims priority pursuant to 35 U.S.C. §119 to Japanese Patent Application No. 2014-109435, filed on May 27, 2014, in the Japan Patent Office, the entire disclosure of which is hereby incorporated by reference herein.

BACKGROUND

1. Technical Field

Exemplary aspects of the present disclosure generally relate to a transfer device and an image forming apparatus including the transfer device, and more particularly to an image forming apparatus such as a copier, a facsimile machine, a printer, or a multi-functional system including a combination thereof.

2. Description of the Related Art

There is known an image forming apparatus equipped with a transfer device that transfers a toner image from an image bearer onto a recording medium interposed in a so-called transfer nip at which the image bearer and a nip forming device contact. A transfer bias is applied to the transfer nip by a transfer bias power source to transfer the toner image from the image bearer onto the recording medium.

As an example of such a transfer device, a secondary transfer device is known to transfer secondarily a composite toner image formed on an intermediate transfer belt onto the recording medium. Toner images formed on a plurality of photoconductors are transferred onto the intermediate transfer belt in primary transfer nips between the photoconductors and the intermediate transfer belt such that they are superimposed one atop the other, thereby forming the composite toner image. The composite toner image is then transferred from the intermediate transfer belt to the recording medium by the secondary transfer device.

The secondary transfer device includes a secondary transfer roller as a nip forming device and a secondary-transfer opposed roller. The secondary transfer roller contacts the intermediate transfer belt serving as an image bearer. The secondary-transfer opposed roller is disposed opposite the secondary transfer roller via the intermediate transfer belt and contacts the intermediate transfer belt from the back thereof. The intermediate transfer belt is interposed between the secondary transfer roller and the secondary-transfer opposed roller to form the transfer nip.

One of the secondary-transfer opposed roller and the secondary transfer roller is connected to the transfer bias power source while the other roller is grounded. The transfer bias power source applies the transfer bias including a direct current (DC) voltage to the one of the secondary-transfer opposed roller and the secondary transfer roller. With this configuration, a secondary transfer electric field is formed between the secondary-transfer opposed roller and the secondary transfer roller so that the toner image moves electrostatically from the secondary-transfer opposed roller side to the secondary transfer roller side. A recording medium is fed to the secondary transfer nip in appropriate timing such that the recording medium is aligned with the toner image formed on the intermediate transfer belt. Due to the secondary transfer electric field and a nip pressure in the secondary transfer nip, the toner image on the intermediate transfer belt is secondarily transferred onto the recording medium.

In this configuration, the transfer bias applied to the secondary transfer roller or to the secondary-transfer opposed roller is subjected to constant current control. When controlling the transfer bias under constant current control, the applied voltage changes in accordance with changes in electrical resistance of the intermediate transfer belt and the secondary transfer roller caused by environmental changes such as temperature and humidity change so that transferability is stable regardless of the environmental change.

In such a configuration described above, when using a recording medium having a coarse surface or an embossed surface such as Japanese paper (also known as Washi), a pattern of light and dark (unevenness of image density) according to the surface condition of the recording medium appears in an output image. More specifically, toner does not transfer well to such embossed surfaces, in particular, recessed portions of the surface. This inadequate transfer of the toner appears as a pattern of light and dark patches in the resulting output image.

SUMMARY

In view of the foregoing, in an aspect of this disclosure, there is provided an improved transfer device including an image bearer, a nip forming device, a transfer bias power source, a contact-and-separation device, and a controller. The image bearer bears a toner image on a surface of the image bearer. The nip forming device contacts the image bearer to form a transfer nip between the nip forming device and the image bearer. The transfer bias power source includes a direct current (DC) power source and an alternating current (AC) power source electrically connected to each other, to output a transfer bias including at least one of a DC bias and a superimposed bias in which a DC voltage and an AC voltage are superimposed to transfer a toner image borne on the image bearer onto a recording medium interposed between the nip forming device and the image bearer in the transfer nip. The contact-and-separation device causes the image bearer and the nip forming device to contact and separate from each other. The controller controls the contact-and-separation device to increase a size of a space between the image bearer and the nip forming device upon transfer using the superimposed bias such that the size of the space upon transfer using the superimposed bias is larger than a size of the space upon transfer using the DC bias.

An image forming apparatus includes the transfer device to transfer the toner image formed on the image bearer onto the recording medium.

The aforementioned and other aspects, features and advantages would be more fully apparent from the following detailed description of illustrative embodiments, the accompanying drawings and the associated claims.

BRIEF DESCRIPTION OF THE SEVERAL VIEWS OF THE DRAWINGS

A more complete appreciation of the disclosure and many of the attendant advantages thereof will be more readily obtained as the same becomes better understood by reference to the following detailed description of illustrative embodiments when considered in connection with the accompanying drawings, wherein.

DETAILED DESCRIPTION

Figure 1:
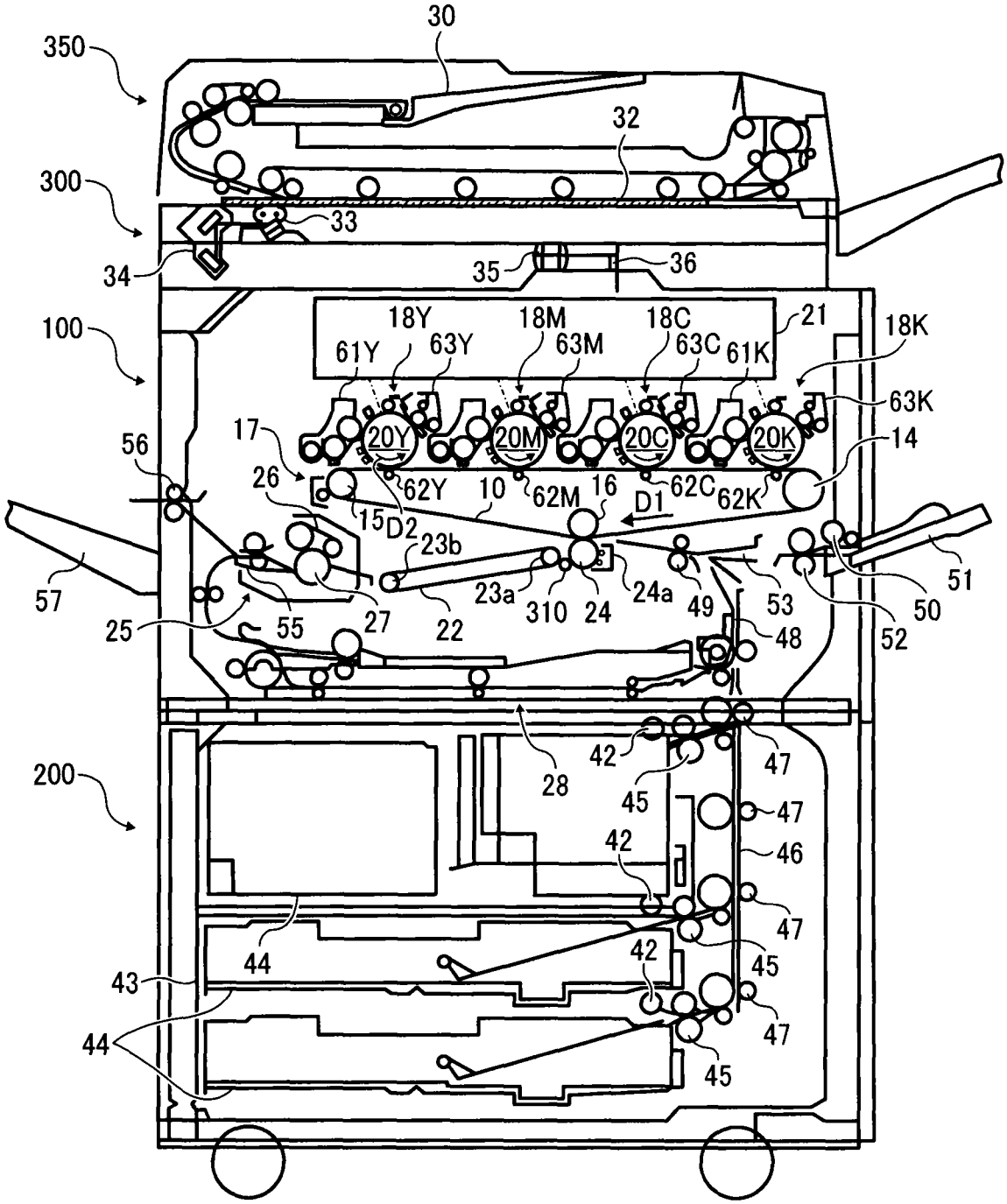
FIG. 1 is a schematic diagram illustrating a copier as an example of an image forming apparatus according to an illustrative embodiment of the present disclosure.

A description is now given of illustrative embodiments of the present invention. It should be noted that although such terms as first, second, etc. may be used herein to describe various elements, components, regions, layers and/or sections, it should be understood that such elements, components, regions, layers and/or sections are not limited thereby because such terms are relative, that is, used only to distinguish one element, component, region, layer or section from another region, layer or section. Thus, for example, a first element, component, region, layer or section discussed below could be termed a second element, component, region, layer or section without departing from the teachings of this disclosure.

In addition, it should be noted that the terminology used herein is for the purpose of describing particular embodiments only and is not intended to be limiting of this disclosure. Thus, for example, as used herein, the singular forms "a", "an" and "the" are intended to include the plural forms as well, unless the context clearly indicates otherwise. Moreover, the terms "includes" and/or "including", when used in this specification, specify the presence of stated features, integers, steps, operations, elements, and/or components, but do not preclude the presence or addition of one or more other features, integers, steps, operations, elements, components, and/or groups thereof.

In describing illustrative embodiments illustrated in the drawings, specific terminology is employed for the sake of clarity. However, the disclosure of this patent specification is not intended to be limited to the specific terminology so selected, and it is to be understood that each specific element includes all technical equivalents that have the same function, operate in a similar manner, and achieve a similar result.

In a later-described comparative example, illustrative embodiment, and alternative example, for the sake of simplicity, the same reference numerals will be given to constituent elements such as parts and materials having the same functions, and redundant descriptions thereof omitted.

Typically, but not necessarily, paper is the medium from which is made a sheet on which an image is to be formed. It should be noted, however, that other printable media are available in sheet form, and accordingly their use here is included. Thus, solely for simplicity, although this Detailed Description section refers to paper, sheets thereof, paper feeder, etc., it should be understood that the sheets, etc., are not limited only to paper, but include other printable media as well.

Referring now to the drawings, wherein like reference numerals designate identical or corresponding parts throughout the several views, exemplary embodiments of the present patent application are described.

FIG. 1 is a schematic diagram illustrating a copier as an example of an image forming apparatus according to an illustrative embodiment of the present disclosure. The image forming apparatus includes a printer unit 100, a paper feed unit 200, and a scanner 300. The printer unit 100 includes an intermediate transfer belt 10 formed into an endless loop. The intermediate transfer belt 10 is entrained about and stretched taut between a drive roller 14, a driven roller 15, and a secondary-transfer opposed roller 16 in such a manner that the loop of the intermediate transfer belt 10 looks like an inverted triangle shape as viewed from the side. The drive roller 14 is rotated by a driving device, and the rotation thereof enables the intermediate transfer belt 10 to travel in a clockwise direction indicated by an arrow D1.

The printer unit 100 includes image forming stations 18Y, 18M, 18C, and 18K, one for each of the colors yellow, magenta, cyan, and black, arranged in horizontally tandem above the looped intermediate transfer belt 10 along the traveling direction of the intermediate transfer belt 10. It is to be noted that the suffixes Y, M, C, and K denote colors yellow, magenta, cyan, and black, respectively. To simplify the description, the reference characters Y, M, C, and K indicating colors are omitted herein unless otherwise specified.

As illustrated in FIG. 1, the image forming stations 18Y, 18M, 18C, and 18K include photoconductors 20Y, 20M, 20C, and 20K, developing devices 61Y, 61M, 61C, and 61K, photoconductor cleaners 63Y, 63M, 63C, and 63K, respectively. The photoconductors 20Y, 20M, 20C, and 20K contact the intermediate transfer belt 10 to form primary transfer nips between each of the photoconductors 20Y, 20M, 20C, and 20K and the intermediate transfer belt 10. The photoconductors 20Y, 20M, 20C, and 20K are driven to rotate in a counterclockwise direction indicated by an arrow D2 by a driving device while contacting the intermediate transfer belt 10.

Each of the developing devices 61Y, 61M, 61C, and 61K develops an electrostatic latent image formed on the photoconductors 20Y, 20M, 20C, and 20K, respectively, by supplying toners of respective colors yellow, magenta, cyan, and black. The photoconductor cleaners 63Y, 63M, 63C, and 63K remove residual toner remaining on the photoconductors 20Y, 20M, 20C, and 20K after a primary transfer process, that is, after the photoconductors 20Y, 20M, 20C, and 20K pass through the primary transfer nips.

According to the present illustrative embodiment, the four image forming stations 18Y, 18M, 18C, and 18K arranged in tandem in the traveling direction of the intermediate transfer belt 10 constitute a tandem image forming unit.

The printer unit 100 includes an optical writing unit 21 substantially above the tandem image forming unit. The optical writing unit 21 scans optically the surface of the photoconductors 20Y, 20M, 20C, and 20K rotating in the counterclockwise direction to form electrostatic latent images on the surfaces of the photoconductors 20Y, 20M, 20C, and 20K in optical writing process. Prior to the optical writing process, the surfaces of the photoconductors 20Y, 20M, 20C, and 20K are uniformly charged by charging devices.

A transfer unit includes the intermediate transfer belt 10 and primary transfer rollers 62Y, 62M, 62C, and 62K disposed inside the loop of the intermediate transfer belt 10. The intermediate transfer belt 10 is interposed between the primary transfer rollers 62Y, 62M, 62C, and 62K, and the photoconductors 20Y, 20M, 20C, and 20K. The primary transfer rollers 62Y, 62M, 62C, and 62K pressingly contact the back of the intermediate transfer belt 10 against the photoconductors 20Y, 20M, 20C, and 20K.

A secondary transfer roller 24 is disposed below the intermediate transfer belt 10 or outside the loop of the intermediate transfer belt 10. The secondary transfer roller 24 contacts a portion of the front surface or the image bearing surface of the intermediate transfer belt 10 wound around the secondary-transfer opposed roller 16, thereby forming a secondary transfer nip therebetween. A sheet of recording medium P is sent to the secondary transfer nip in appropriate timing. In the secondary-transfer nip, the four-color composite toner image is transferred secondarily from the intermediate transfer belt 10 onto the recording medium P.

The scanner 300 includes a reading device 36, i.e., a reading sensor, that reads image information of a document placed on an exposure glass. The obtained image information is sent to the controller of the printer unit 100. Based on the image information provided by the scanner 300, the controller controls light sources such as a laser diode and a light emitting diode (LED) of the optical writing unit 21 to illuminate the photoconductors 20Y, 20M, 20C, and 20K with light for each color. Accordingly, an electrostatic latent image is formed on the surface of each of photoconductors 20Y, 20M, 20C, and 20K. Subsequently, the electrostatic latent image is developed with toner of a respective color through developing process into toner images, one for each of the colors yellow (Y), magenta (M), cyan (C), and black (K).

The paper feed unit 200 includes multiple paper cassettes 44, feed rollers 42, separation rollers 45, a sheet passage 46, conveyor rollers 47, and so forth. One of the feed rollers 42 is selectively rotated so as to feed a recording medium P from one of paper cassettes 44 disposed in a paper bank 43. The separation roller 45 separates a sheet from the stack of recording media P and feeds it to the sheet passage 46. The conveyor rollers 47 delivers the recording medium P to a sheet passage 48 of the printer unit 100.

In addition to the paper feed unit 200, the recording medium P can be supplied manually using a side tray 51 and a separation roller 52. The separation roller 52 picks up and feeds a sheet of recording medium P loaded on the side tray 51 to a sheet passage 53 one sheet at a time. The sheet passage 53 meets the sheet passage 48 in the printer unit 100.

Substantially at the end of the sheet passage 48, a pair of registration rollers 49 is disposed. After the recording medium P delivered along the sheet passage 48 is interposed between the pair of registration rollers 49, the pair of registration rollers 49 feeds the recording medium P to the secondary transfer nip in appropriate timing such that the recording medium P is aligned with the composite toner image formed on the intermediate transfer belt 10 in the secondary transfer nip.

Still referring to FIG. 1, a description is provided of image forming operation for a color image. First, a document is placed on a document table 30 of an auto document feeder (hereinafter simply referred to as ADF) 350 or is placed on an exposure glass 32 of the scanner 300 by opening the ADF 350. When the document is placed on the exposure glass 32, the ADF 350 is closed to hold the document. Then, a start button is pressed by users. In a case in which the document is placed on the document table 30 of the ADF 350, when a start button is pressed by users, the document is sent onto the exposure glass 32.

Subsequently, the scanner 300 is activated, thereby moving a first carriage 33 and a second carriage 34 along the document surface. A light source of the first carriage 33 projects light against the document, which is then reflected on the document. The reflected light is reflected toward the second carriage 34. Mirrors of the second carriage 34 reflect the light toward a focusing lens 35 which directs the light to the reading device 36. The reading device 36 reads the document.

As the printer unit 100 receives the image information from the scanner 300, a recording medium P having an appropriate size corresponding to the image information is supplied to the sheet passage 48. The intermediate transfer belt 10 is rotated endlessly in the clockwise direction by the drive roller 14 which is rotated by a drive motor.

In the meantime, the photoconductors 20Y, 20M, 20C, and 20K of the image forming stations 18Y, 18M, 18C, and 18K are rotated, and the photoconductors 20Y, 20M, 20C, and 20K are subjected to various imaging processes such as charging, optical writing, and development. Through these processes, toner images of yellow, cyan, magenta, and black formed on the surface of photoconductors 20Y, 20M, 20C, and 20K are primarily transferred onto the surface of the intermediate transfer belt 10 in the respective primary transfer nips such that they are superimposed one atop the other, thereby forming a four-color composite toner image on the intermediate transfer belt 10.

In the paper feed unit 200, one of the feed rollers 42 is selectively rotated so as to feed a recording medium P from one of paper cassettes 44 disposed in the paper bank 43. The recording medium P picked up by the feed roller 42 is fed to the sheet passage 46 one by one by the separation roller 45. Subsequently, the recording medium P is delivered to the sheet passage 48 in the printer unit 100 by the conveyor rollers 47.

When using the side tray 51, a feed roller 50 of the side tray 51 is driven to rotate to pick up the recording medium P loaded on the side tray 51. Then, the separation roller 52 separates and feeds the recording medium P to the sheet passage 53. The recording medium P is delivered to the sheet passage 48. Near the sheet passage 48, the leading end of the recording medium P comes into contact with the pair of registration rollers 49, and delivery of the recording medium P stops temporarily.

Subsequently, the pair of registration rollers 49 starts to rotate again to feed the recording medium P to the secondary transfer nip in appropriate timing such that the recording medium P is aligned with the four-color composite toner image formed on the intermediate transfer belt 10 in the secondary transfer nip. In the secondary transfer nip, due to transfer pressure and electric field the composite toner image is secondarily transferred onto the recording medium P.

The recording medium P, onto which the composite toner image is transferred at the secondary transfer nip, is carried on a conveyor belt 22 and delivered to a fixing device 25. The fixing device 25 includes a pressing roller 27 and a fixing belt 26 contacting the pressing roller 27 to form a fixing nip therebetween. In the fixing device 25, the composite toner image is fixed on the recording medium P as the recording medium P passes through the fixing nip between the fixing belt 26 and the pressing roller 27 where heat and pressure are applied. After the color toner image is formed on the recording medium P, the recording medium P is output by a pair of output rollers 56 onto an output tray 57 disposed at the exterior wall of the printer unit 100.

In the case of double-sided printing, after the recording medium P is discharged from the fixing device 25, a switching claw 55 changes the delivery path of the recording medium P to send it to a reversing unit 28. In the reversing unit 28, the recording medium P is turned upside down and returned to the pair of registration rollers 49.

A belt cleaner 17 is disposed outside the looped intermediate transfer belt 10 and contacts the intermediate transfer belt 10 upstream from the primary transfer nip for yellow which is the extreme upstream end in the primary transfer process among the four colors.

In order to facilitate an understanding of the novel features of the present invention, as a comparison, a description is provided of a comparative example of a transfer device employed in an image forming apparatus.

In one example, the comparative example of the transfer device of the image forming apparatus employs a transfer bias power source including a DC power source and an AC power source connected to each other to apply a superimposed bias in which an AC voltage is superimposed on a DC voltage. Using such a superimposed bias, toner particles may travel back and forth between the recessed portions of the recording medium surface and the image bearer, thereby allowing the toner particles to contact the recessed portions of the recording medium surface and hence preventing transfer failure.

At this time, if the traveling speed of the intermediate transfer belt changes suddenly, an image to be transferred onto the intermediate transfer belt from the photoconductor in the primary transfer nip stretches or shrinks undesirably. As a result, the density of toner changes at a place where the density should be constant, thereby generating undesirable streaking or a so-called shock jitter.

Such a sudden change in the traveling speed of the intermediate transfer belt occurs when the recording medium enters the secondary transfer nip at which the intermediate transfer belt and the secondary transfer device meet and press against each other in the secondary transfer process. In order to reduce the shock jitter, before the recording medium enters the secondary transfer nip, the secondary transfer roller is separated from the intermediate transfer belt by an eccentric cam of a contact-and-separation device. Accordingly, the secondary transfer roller and the intermediate transfer belt are separated, and a certain space is formed therebetween, hence reducing shock jitter when the recording medium enters the secondary transfer nip.

Furthermore, immediately after the leading end of the recording medium enters the space, the secondary transfer roller is released by the eccentric cam and is pushed against the intermediate transfer belt by a spring. In this configuration, the secondary transfer roller contacts the intermediate transfer belt, and adequate transfer pressure is obtained at the secondary transfer nip during transfer, thereby preventing transfer failure.

Although advantageous, if the secondary transfer roller and the intermediate transfer belt are not separated enough, that is, the space therebetween is too small, the transfer bias applied to one of the secondary transfer roller and the transfer opposed roller leaks to the other roller. As a result, the rise time of the voltage takes long. Since a higher transfer bias is required of embossed paper than regular paper, the transfer bias gets inadequate at the leading end of the image upon transfer, and thus the image density at the leading end is low undesirably.

In view of the above, there is demand for a transfer device capable of preventing transfer failure upon transfer using a superimposed bias, and an image forming apparatus including the transfer device.

Figure 2:
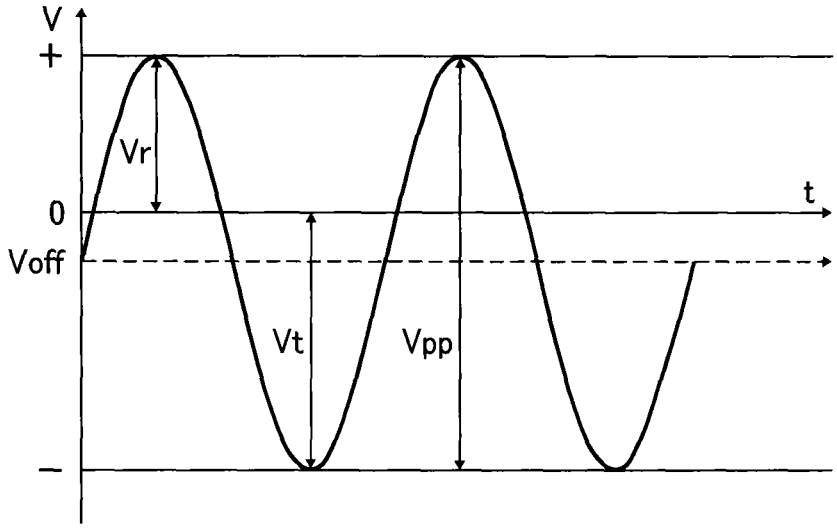
FIG. 2 is a waveform chart showing a waveform of a secondary bias including a superimposed bias output from a secondary transfer bias power source.

With reference to FIG. 2, a description is provided of a secondary transfer bias output from a secondary transfer bias power source 309 (shown in FIG. 4) according to an illustrative embodiment of the present disclosure. FIG. 2 is a waveform chart showing a waveform of the secondary bias consisting of a superimposed bias in which a direct current (DC) voltage is superimposed on an alternating current (AC) voltage. According to the present illustrative embodiment, the secondary transfer bias is applied to the metal cored bar of the secondary-transfer opposed roller 16. The secondary transfer bias power source 309 serving as a voltage output device functions as a transfer bias application device that applies a transfer bias.

Furthermore, as described above, when the secondary transfer bias is applied to the metal cored bar of the secondary-transfer opposed roller 16, a potential difference is generated between the metal cored bar of the secondary-transfer opposed roller 16 serving as a first transfer part and the metal cored bar of the secondary transfer roller 24 serving as a second transfer part. In other words, the secondary transfer bias power source 309 serves also as a potential difference generator. In general, a potential difference is treated as an absolute value. However, in this specification, the potential difference is expressed with polarity.

More specifically, a value obtained by subtracting the potential of the metal cored bar of the secondary transfer roller 24 from the potential of the metal cored bar of the secondary-transfer opposed roller 16 is treated as the potential difference. Using toner having the negative polarity as in the illustrative embodiment, when the polarity of the time-averaged value of the potential difference becomes negative, the potential of the secondary transfer roller 24 is increased beyond the potential of the secondary-transfer opposed roller 16 toward the opposite polarity of the charge on the toner (the positive side in the present illustrative embodiment). Accordingly, the toner is electrostatically moved from the secondary-transfer opposed roller side to the secondary transfer roller side.

In FIG. 2, an offset voltage Voff is a value of a DC component of the secondary transfer bias. A peak-to-peak voltage Vpp is a peak-to-peak voltage of an AC component of the secondary transfer bias.

According to the present illustrative embodiment, the superimposed bias consists of a superimposed voltage in which the offset voltage Voff and the peak-to-peak voltage Vpp are superimposed. Thus, the time-averaged value of the superimposed bias coincides with the offset voltage Voff.

As described above, according to the present illustrative embodiment, the secondary transfer bias is applied to the metal cored bar of the secondary-transfer opposed roller 16 while the metal cored bar of the secondary transfer roller 24 is grounded (OV). Thus, the potential of the metal core of the secondary-transfer opposed roller 16 itself becomes the potential difference between the potentials of the metal core of the secondary-transfer opposed roller 16 and the secondary transfer roller 24. The potential difference between the potentials of the metal cored bar of the secondary-transfer opposed roller 16 and the metal cored bar of the secondary transfer roller 24 consists of a direct current component (Eoff) having the same value as the offset voltage Voff and an alternating current component (Epp) having the same value as the peak-to-peak voltage (Vpp).

Figure 3:
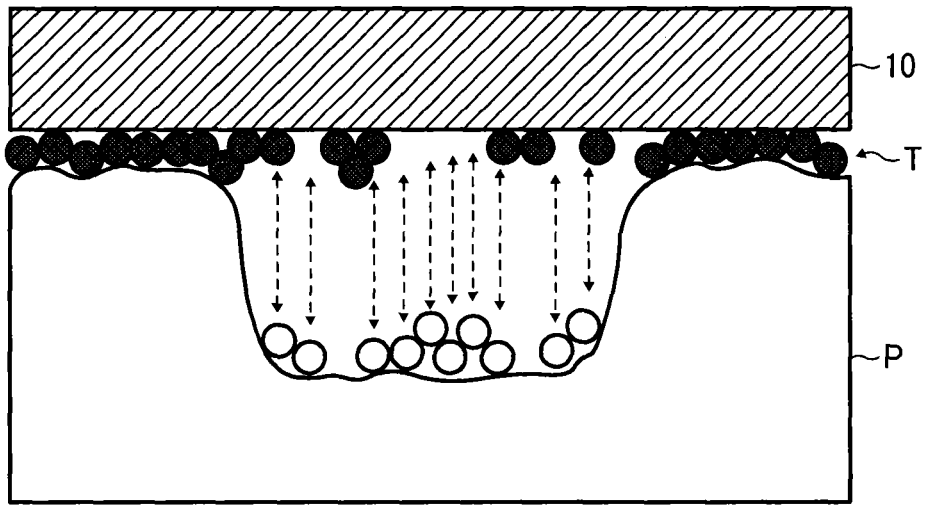
FIG. 3 is a schematic diagram illustrating an example of behavior of toner adhering to a recording medium when the secondary transfer bias power source applies the superimposed bias to a secondary-transfer opposed roller.

According to the present illustrative embodiment, as illustrated in FIG. 3, the polarity of the offset voltage Voff is negative. According to the present illustrative embodiment, when the polarity of the offset voltage Voff of the secondary transfer bias applied to the secondary-transfer opposed roller 16 is negative, the toner having the negative polarity is repelled by the secondary-transfer opposed roller 16, pushing the toner toward the secondary transfer roller 24.

When the polarity of the secondary transfer bias is negative so is the polarity of the toner, the toner having the negative polarity is pushed out electrostatically from the secondary-transfer opposed roller 16 to the secondary transfer roller 24 in the secondary transfer nip. Accordingly, the toner on the intermediate transfer belt 10 is transferred onto the recording medium P.

By contrast, when the polarity of the secondary transfer bias is opposite that of the toner, that is, the polarity of the secondary transfer voltage is positive, the toner having the negative polarity is attracted electrostatically to the secondary-transfer opposed roller 16 from the secondary transfer roller 24. Consequently, the toner transferred to the recording medium P is attracted again to the intermediate transfer belt 10.

It is to be noted that because the time-averaged value (the same value as the offset voltage Voff in the present embodiment) of the secondary transfer bias has the negative polarity, the toner is pushed electrostatically from the secondary-transfer opposed roller side to the transfer roller side, relatively speaking. In FIG. 3, Vr represents a return-direction peak potential having a peak at a positive side which is opposite the polarity of the toner. Vt represents a transfer-direction peak potential having a peak at a negative side.

With reference to FIG. 3, a description is provided of principles of toner adhering to the recording medium P when the superimposed bias is applied to the secondary-transfer opposed roller 16 by the secondary transfer bias power source 309.

In a case in which the superimposed bias is applied to the secondary-transfer opposed roller 16, the waveform has an AC waveform in which a voltage moving from the secondary-transfer opposed roller 16 to the secondary transfer roller 24 and a voltage moving from the secondary transfer roller 24 to the secondary-transfer opposed roller 16 alternate in a predetermined cycle. As a result, toner particles T in the composite toner image formed on the intermediate transfer belt 10 start to move in a transfer direction toward the recording medium P and in an opposite direction. When the voltage reaches a certain level, the toner particles stick to recessed portions of the recording medium P.

Figure 4:
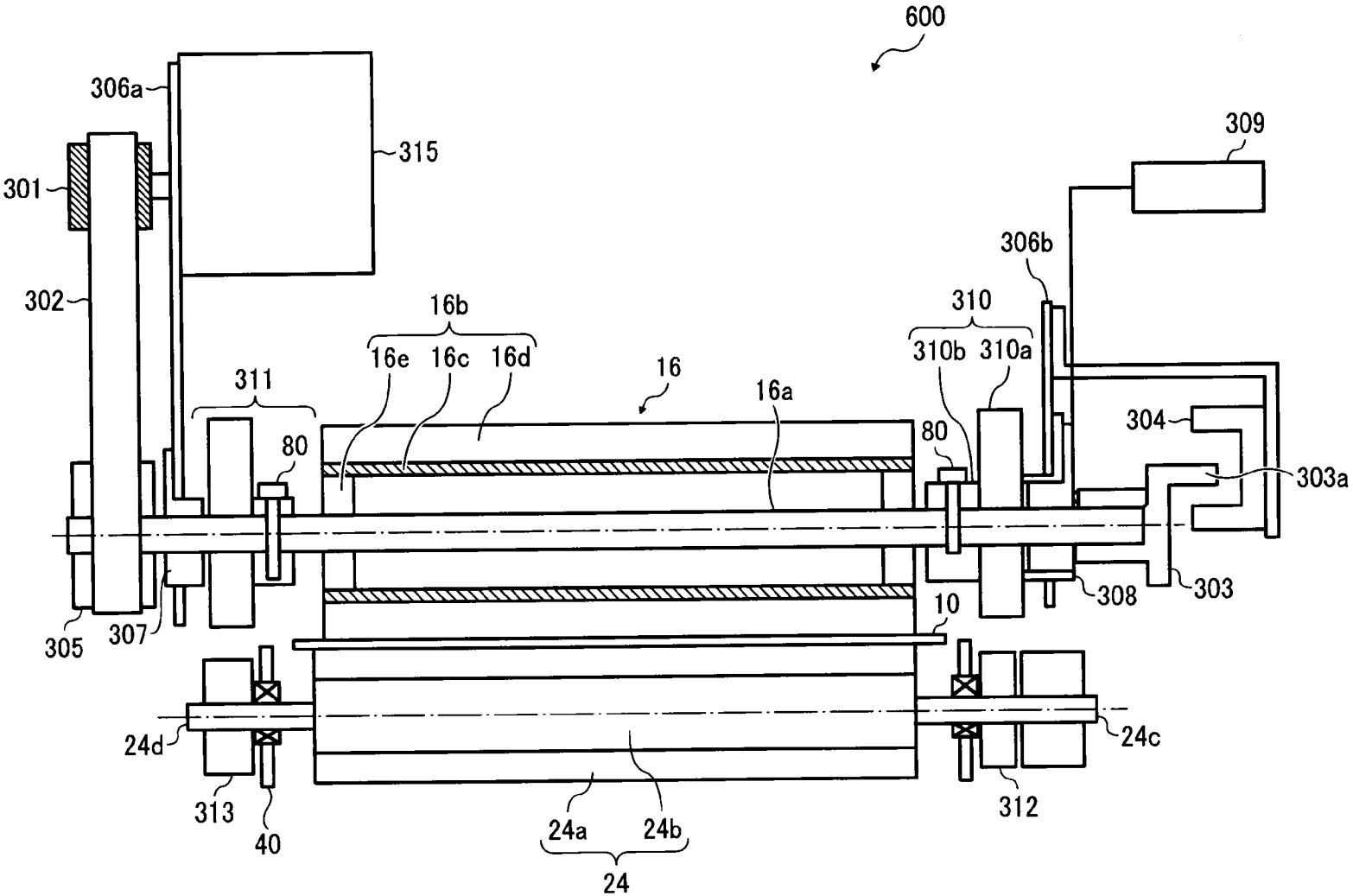
FIG. 4 is a schematic diagram illustrating a contact-and-separation device that causes an intermediate transfer belt and a secondary transfer roller to contact and separate from each other.

Referring now to FIG. 4, there is provided a schematic diagram illustrating a contact-and-separation device 600 serving as a moving device that causes the intermediate transfer belt 10 and the secondary transfer roller 24 to contact and separate from each other. The secondary transfer roller 24 includes a hollow, cylindrical metal cored bar 24*b*, an elastic layer 24*a* fixed to the circumferential surface of the cylindrical metal cored bar 24*b*, a first shaft 24*c*, a second shaft 24*d*, a first idler roller 312, and a second idler roller 313. The first shaft 24*c* and the second shaft 24*d* project from each end surface of the secondary transfer roller 24 in the axial direction. The elastic layer 24*a* is formed of elastic material.

The material constituting the cylindrical metal cored bar 24*b* includes, but is not limited to, stainless steel and aluminum. The elastic layer 24*a* has a hardness of 70° or less on Japanese Industrial Standards (JIS)-A hardness scale, for example.

In a configuration in which a cleaning device such as a cleaning blade contacts the secondary transfer roller 24 to clean the surface thereof, the elastic layer 24*a* which is too soft will cause various problems such as damage. Therefore, it is desirable that the elastic layer 24*a* have a hardness of 40° or more on JIS-A hardness scale, for example. In a case in which the secondary transfer roller 24 is not equipped with a cleaning device, the elastic layer 24*a* can be soft, thereby preventing imaging failure caused by stress applied to the secondary transfer nip when the recording medium P enters and exits the secondary transfer nip. In view of the above and in terms of productivity, a desired hardness of the elastic layer 24*a* is in a range from 40° to 50° on Asker C hardness scale.

The conductive rubber material for the elastic layer 24*a* of the secondary transfer roller 24 includes, but is not limited to, conductive epichlorohydrin rubber, Ethylene Propylene Diene Monomer (EPDM) and Si rubber in which carbon is dispersed, nitrile butadiene rubber (NBR) having ionic conductive properties, and urethane rubber. The elastic layer 24*a* fixed on the circumferential surface of the cylindrical metal cored bar 24*b* is made of conductive rubber with the resistance value thereof adjusted to have a resistance in a range of 6.5 to 7.5 Log Ω.

The electrical resistance of the elastic layer 24*a* is adjusted to a predetermined range to prevent concentration of transfer electric current at a place of contact at which the intermediate transfer belt 10 and the secondary transfer roller 24 directly contact without the recording medium P in the secondary transfer nip when a relatively small recording medium P in the axial direction of the roller, such as A5-size, is used. With an electrical resistance of the elastic layer 24*a* greater than the electrical resistance of the recording medium P, the concentration of the transfer electrical current is prevented.

The conductive rubber material for the elastic layer 24*a* includes foam rubber having a hardness in a range from 40° to 50° on Asker C hardness scale. With this configuration, the elastic layer 24*a* can deform flexibly in a thickness direction in the secondary transfer nip, thereby making the secondary transfer nip relatively wide in a transport direction of the recording medium P.

The elastic layer 24*a* has a barrel shape with a center thereof having a larger outer diameter than that of the end portions. With this configuration, the pressure at the center portion of the secondary transfer roller 24 is prevented from decreasing when the secondary transfer roller 24 is pressed against the intermediate transfer belt 10 by a coil spring 351 (shown in FIG. 6) to form the secondary transfer nip and hence the secondary transfer roller 24 is bent.

The secondary transfer roller 24 is pressed against the intermediate transfer belt 10 entrained about the secondary-transfer opposed roller 16. The secondary-transfer opposed roller entrained about the intermediate transfer belt 10 includes a cylindrical roller portion 16*b* as a main body and a shaft 16*a*. The shaft 16*a* penetrates through the center of rotation of the roller portion 16*b* in the axial direction while allowing the roller portion 16*b* to rotate idle on the shaft 16*a*.

The shaft 16*a* is made of metal and allows the roller portion 16*b* to rotate idle freely on the circumferential surface thereof. The roller portion 16*b* as a main body includes a drum-shaped cylindrical metal cored bar 16*c*, an elastic layer 16*d*, and a ball bearing 16*e*. The elastic layer 16*d* is fixed on the circumferential surface of the cylindrical metal cored bar 16*c* and made of elastic material. The ball bearing 16*e* is press fit to both ends of the cylindrical metal cored bar 16*c* in the axial direction thereof. While supporting the cylindrical metal cored bar 16*c*, the ball bearings 16*e* rotate on the shaft 16*a* together with the cylindrical metal cored bar 16*c*. The elastic layer 16*d* is formed on the outer circumferential surface of the cylindrical metal cored bar 16*c*.

More specifically, the shaft 16*a* is rotatably supported by a first shaft bearing 308 and a second ball bearing 307. The first shaft bearing 308 is fixed to a first lateral plate 306*b* of the transfer unit that supports the intermediate transfer belt 10 in a stretched manner. The second ball bearing 307 is fixed to a second lateral plate 306*a*. It is to be noted that the shaft 16*a* does not rotate most of the time during print job. The shaft 16*a* allows the roller portion 16*b* that tries to rotate together with the intermediate transfer belt 10 traveling endlessly to rotate idle on the shaft 16*a*.

The elastic layer 16*d* is formed on the outer circumferential surface of the cylindrical metal cored bar 16*c* and is made of nitrile butadiene rubber (NBR) that makes the resistance in a range of 7.0 to 8.0 Log Ω.

The rubber material for the elastic layer 16*d* includes nitrile butadiene rubber (NBR) so that the elastic layer 16*d* has a hardness in a range from 48° to 58° on JIS-A hardness scale.

Cams are fixed to both ends of the shaft 16*a* of the secondary-transfer opposed roller 16, outside the roller portion 16*b* in the longitudinal direction thereof. Each of the cams serves as contact parts that come into contact with the secondary transfer roller 24.

More specifically, a first cam 310 is fixed to one end of the shaft 16*a* of the secondary-transfer opposed roller 16 in the longitudinal direction thereof. The first cam 310 is an eccentric cam for position adjustment. The first cam 310 includes a cam portion 310*a* and a true-circular roller portion 310*b*. The cam portion 310*a* and the roller portion 310*b* are arranged in the axial direction and constitute a single integrated unit. The roller portion 310*b* includes a parallel pin 80 that penetrates through the shaft 16*a*, thereby fixing the first cam 310 to the shaft 16*a*. A second cam 311 has the same configurations as that of the first cam 310, and is fixed to the other end of the shaft 16*a* in the longitudinal direction thereof. The second cam 311 is an eccentric cam for position adjustment.

Furthermore, a power receiving pulley 305 is fixed outside the second cam 311 in the axial direction of the shaft 16*a*. A detection target disk 303 is fixed to the shaft 16*a* outside the first cam 310 in the axial direction of the shaft 16*a*. A cam drive motor 315 is fixed to the second lateral plate 306*a* of the transfer unit. A motor pulley 301 disposed on the shaft of the cam drive motor 315 is rotated so as to transmit, via a timing belt 302, a driving force to the power receiving pulley 305 fixed to the shaft 16*a*.

With this configuration, the shaft 16*a* is rotated by driving the cam drive motor 315. Even when the shaft 16*a* is rotated, the roller portion 16*b* can rotate idle freely on the shaft 16*a* so that the roller portion 16*b* can rotate together with the belt.

A stepping motor is employed as the cam drive motor 315, thereby providing a greater freedom in setting the angle of rotation of the motor without a rotation angle detector such as an encoder.

When the shaft 16*a* stops rotating at a predetermined angle, the cam portions of the first cam 310 and the second cam 311 come into contact with the first idler roller 312 and the second idler roller 313. The first idler roller 312 and the second idler roller 313 are disposed on the shaft of the secondary transfer roller 24. Subsequently, the secondary transfer roller 24 is pushed against the pressure of the coil spring 351 of a roller unit retainer.

With this configuration, the distance between the shaft of the secondary-transfer opposed roller 16 and the shaft of the secondary transfer roller 24 is adjusted by moving the secondary transfer roller 24 away from the secondary-transfer opposed roller 16, in other words, away from the intermediate transfer belt 10.

According to the present illustrative embodiment, the first cam 310, the second cam 311, the cam drive motor 315, the roller unit retainer, and so forth constitute a distance adjuster that adjusts the distance between the secondary-transfer opposed roller 16 and the secondary transfer roller 24. As described above, the secondary-transfer opposed roller 16 serving as a rotatable support roller includes the cylindrical roller portion 16*b* and the shaft 16*a* that penetrates through the center of rotation of the roller portion 16*b* such that the roller portion 16*b* can rotate idle on the shaft 16*a*.

Rotation of the shaft 16*a* enables the first cam 310 and the second cam 311 fixed to both ends of the shaft 16*a* in the axial direction thereof to rotate together. Thus, the cams at both ends of the shaft 16*a*, that is, the first cam 310 and the second cam 311, can be rotated by providing a power transmission device for transmission of power to the shaft 16*a* only at one end of the shaft 16*a* in the axial direction.

As described above, according to the present illustrative embodiment, the secondary transfer bias having the same polarity as that of the toner is applied to the metal cored bar of the secondary-transfer opposed roller 16 while the metal cored bar 24*b* of the secondary transfer roller 24 is grounded. With this configuration, the secondary transfer electric field is formed between the secondary-transfer opposed roller 16 and the secondary transfer roller 24 so that the toner moves electrostatically from the secondary-transfer opposed roller side to the secondary transfer roller side.

The first shaft bearing 308 that rotatably supports the shaft 16*a* made of metal is constituted of a conductive slide bearing. The secondary transfer bias power source 309 is connected to the conductive first shaft bearing 308 to output the secondary transfer bias.

The secondary transfer bias output from the secondary transfer bias power source 309 is directed to the secondary-transfer opposed roller 16 via the first shaft bearing 308. The secondary transfer bias is transmitted through the shaft 16*a*, the ball bearing 16*e*, the metal cored bar 16*c* and the elastic layer 16*d*, accordingly. The shaft 16*a*, the ball bearing 16*e*, and the metal cored bar 16*c* are made of metal, and the elastic layer 16*d* is conductive.

The detection target disk 303 fixed to one end of the shaft 16*a* includes a detection target 303*a*. The detection target 303*a* rises in the axial direction at a predetermined position in the direction of rotation of the shaft 16*a*. An optical detector 304 is fixed to a detector bracket which is fixed to the first lateral plate 306*b* of the transfer unit.

While the shaft 16*a* rotates and comes to a predetermined rotation angle range, the detection target 303*a* of the detection target disk 303 enters between a light emitting element of the optical detector 304 and a light receiving element, shutting off the optical path therebetween. The light receiving element of the optical detector 304 sends a light receiving signal when receiving light from the light emitting element.

Based on the time at which the light receiving signal from the light receiving element is cut off and/or based on a driving amount of the cam drive motor from this time, the controller recognizes the rotation angle position of the cam portions of the first cam 310 and the second cam 311 fixed to the shaft 16*a*.

As described above, the first cam 310 and the second cam 311 come into contact with the first idler roller 312 and the second idler roller 313 at a predetermined rotation angle, thereby pushing the secondary transfer roller 24 away from the secondary-transfer opposed roller 16 against the pressure of the coil spring 351. Thereafter, for the sake of convenience, this pushing movement of the secondary transfer roller 24 is referred to as a push down.

The amount of push down is determined by the rotation angle position of the first cam 310 and the second cam 311. The greater is the amount of push down of the secondary transfer roller 24, the greater is the distance between the secondary-transfer opposed roller 16 and the secondary transfer roller 24.

The first idler roller 312 is disposed on the first shaft 24*c* of the secondary transfer roller 24 such that the first idler roller 312 can rotate idle. The first idler roller 312 is a ball bearing with an outer diameter slightly smaller than that of the secondary transfer roller 24 and can rotate idle on the circumferential surface of the first shaft 24*c*. The second idler roller 313 having the same configuration as that of the first idler roller 312 is disposed on the second shaft 24*d* of the secondary transfer roller 24 such that the first idler roller 312 can rotate idle.

As described above, the first cam 310 and the second cam 311 fixed to the shaft 16*a* of the secondary-transfer opposed roller 16 come into contact with the first idler roller 312 and the second idler roller 313 at a predetermined rotation angle. More specifically, the first cam 310 fixed to one end of the shaft 16*a* comes into contact with the first idler roller 312. At the same time, the second cam 311 fixed to the other end of the shaft 16*a* comes into contact with the second idler roller 313.

Rotation of the first idler roller 312 and the second idler roller 313 is stopped when the first idler roller 312 and the second idler roller 313 contact the first cam 310 and the second cam 311 of the secondary-transfer opposed roller 16. However, rotation of the secondary transfer roller 24 is not hindered. Even when rotation of the first idler roller 312 and the second idler roller 313 stops, because the first idler roller 312 and the second idler roller 313 are ball bearings, the first shaft 24*c* and the second shaft 24*d* of the secondary transfer roller 24 can freely rotate independent of the idler rollers.

Rotation of the first idler roller 312 and the second idler roller 313 is stopped when the first idler roller 312 and the second idler roller 313 contact the first cam 310 and the second cam 311. This configuration prevents sliding friction of the cams and the idler rollers, while preventing an increase in the torque of the belt drive motor and the drive motor for the secondary transfer roller 24.

Figure 12:
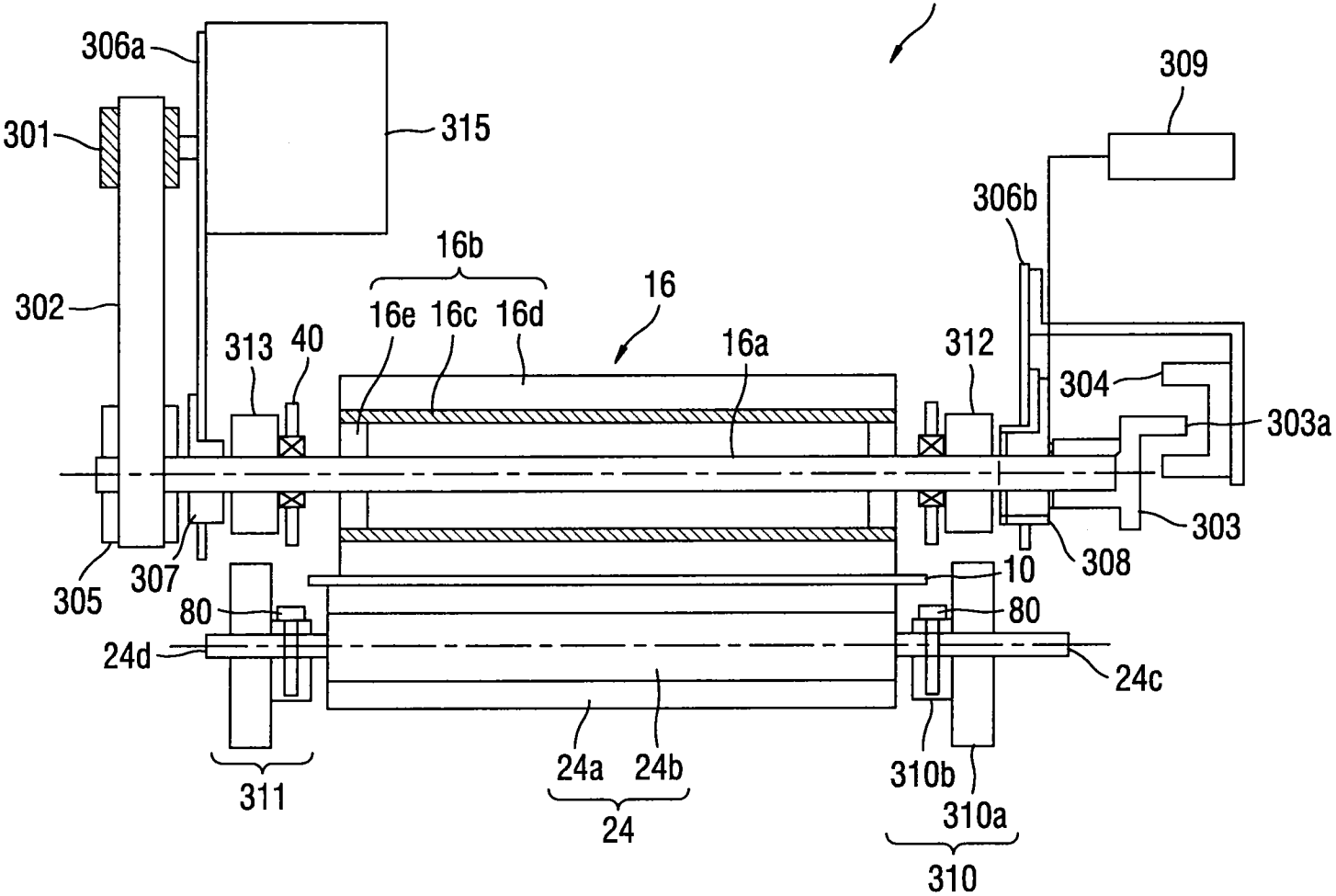
FIG. 12 corresponds to FIG. 4 but has the cams and idler rollers interchanged as compared to FIG. 4.

According to the present illustrative embodiment, in the contact-and-separation device 600 shown in FIG. 4, the secondary-transfer opposed roller 16 includes the first cam 310 and the second cam 311, and the secondary transfer roller 24 includes the first idler roller 312 and the second idler roller 313. Alternatively, in some embodiments, the secondary transfer roller 24 includes the first cam 310 and the second cam 311, and the secondary-transfer opposed roller 16 includes the first idler roller 312 and the second idler roller 313, as shown in FIG. 12.

Figure 5:
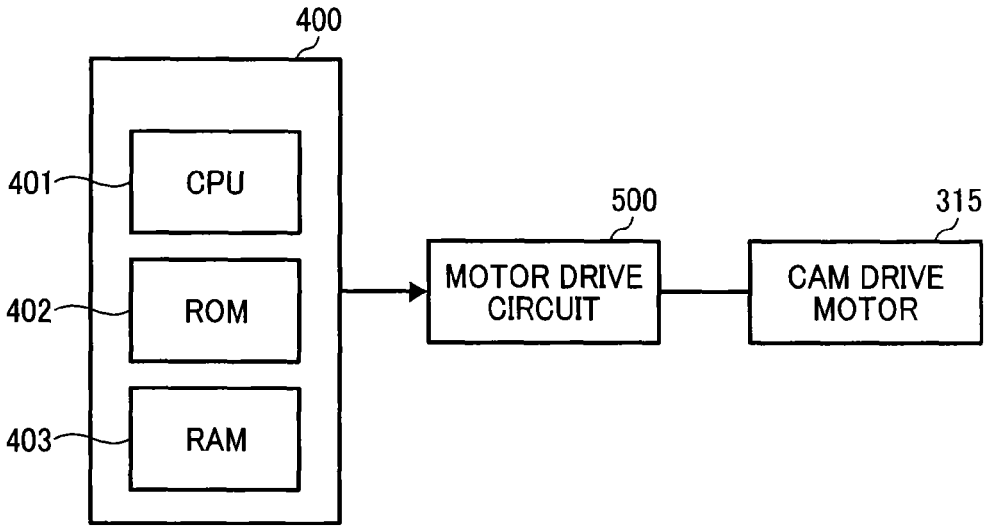
FIG. 5 is a block diagram illustrating a controller 400 employed in the image forming apparatus according to the illustrative embodiment of the present disclosure.

FIG. 5 is a block diagram illustrating a controller 400 of the image forming apparatus according to an illustrative embodiment of the present disclosure.

The image forming apparatus includes the controller 400 that controls various operations including an image reading operation and an image forming operation. The controller includes a central processing unit (CPU) 401 to carry out control programs, a Read Only Memory (ROM) 402 to store the control programs, and a Random Access Memory (RAM) 403 to allow the control programs to be read and to temporarily store data.

A motor drive circuit 500 serving as a cam controller is operatively connected to the controller 400 to control the cam drive motor 315. The controller 400 controls the cam drive motor 315 via the motor drive circuit 500 using the control programs stored in the ROM 402. Accordingly, the controller 400 controls rotation of the first cam 310 and the second cam 311.

In the present illustrative embodiment, the intermediate transfer belt 10 and the secondary transfer roller 24 are separated as needed in order to reduce shock jitter which occurs when the recording medium enters and exits the secondary transfer nip and to prevent contamination of the recording medium with a test image for adjustment of image density formed between successive recording media sheets.

Figure 6:
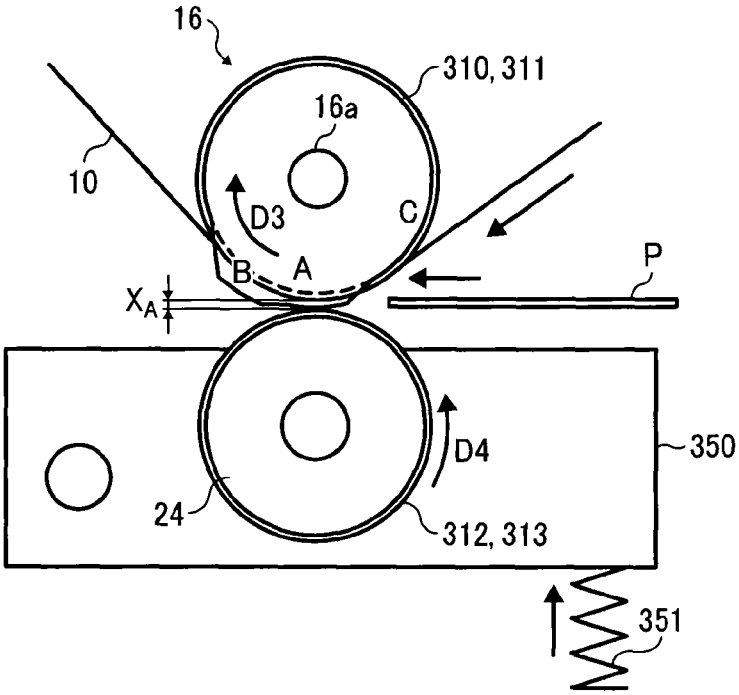
FIG. 6 is a schematic diagram illustrating a secondary transfer nip before the recording medium advances to the secondary transfer nip during transfer process using a direct current (DC) bias as the secondary transfer bias.
Figure 7:
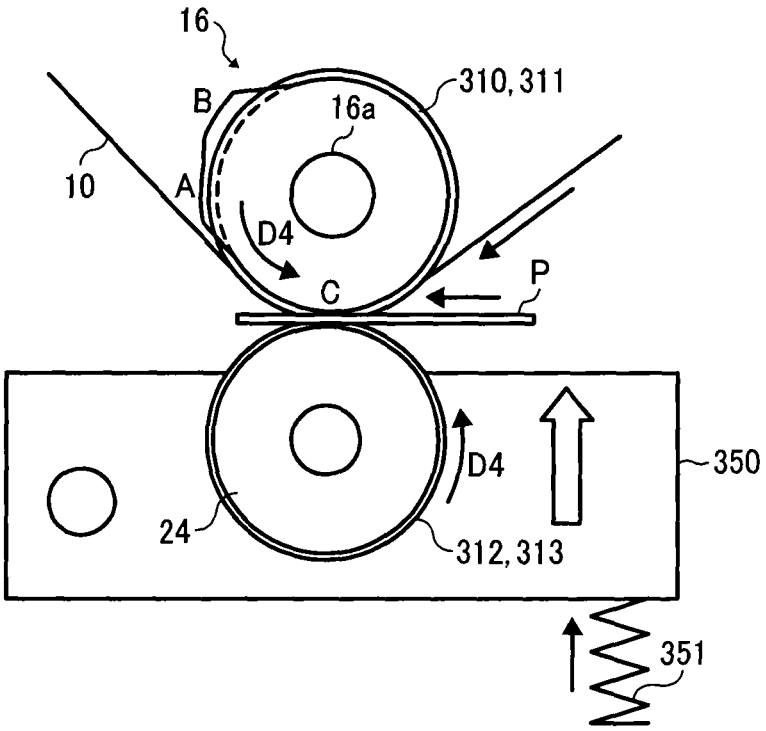
FIG. 7 is a schematic diagram illustrating the secondary transfer nip after the recording medium enters the secondary transfer nip during transfer process using the DC bias as the secondary transfer bias.
Figure 8:
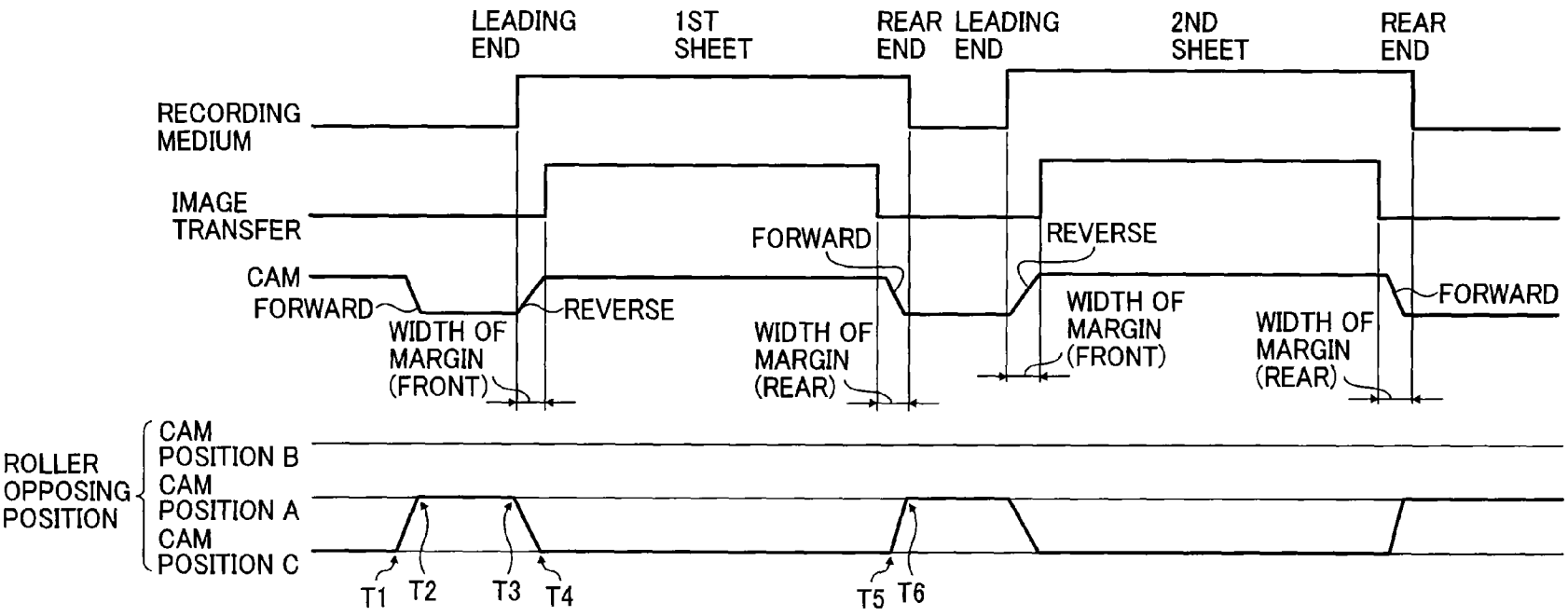
FIG. 8 is a timing diagram of rotation of cams during transfer process using the DC bias as the secondary transfer bias.

FIG. 6 is a schematic diagram illustrating a secondary transfer nip before the recording medium P advances to a secondary transfer nip during the transfer process using a direct current (DC) bias as the secondary transfer bias. FIG. 7 is a schematic diagram illustrating the secondary transfer nip after the recording medium P enters the secondary transfer nip during the transfer process using the DC bias as the secondary transfer bias. FIG. 8 is a timing diagram of rotation of the first cam 310 and the second cam 311 during the transfer process using the DC bias as the secondary transfer bias.

With reference to FIGS. 6 through 8, a description is provided of movement of the intermediate transfer belt 10 and the secondary transfer roller 24 during DC bias transfer process using the DC bias as the secondary transfer bias.

There are three stop positions, that is, a cam position A, a cam position B, and a cam position C, at which the first cam 310 and the second cam 311 stop.

As shown in FIG. 6, when the first cam 310 and the second cam 311 are situated at the cam position A, the first cam 310 and the second cam 311 contact the first idler roller 312 and the second idler roller 313, respectively, thereby separating the intermediate transfer belt 10 and the secondary transfer roller 24 from each other to form a space $X_A$ therebetween.

As shown in FIG. 7, when the first cam 310 and the second cam 311 are situated at the cam position C, the first cam 310 and the second cam 311 do not contact the first idler roller 312 and the second idler roller 313 so that the intermediate transfer belt 10 and the secondary transfer roller 24 contact.

According to the present illustrative embodiment, when performing transfer with a DC transfer bias, first, the first cam 310 and the second cam 311 situated at the cam position B are rotated forward in a direction of arrow D3 (in a clockwise direction in FIG. 6) before the first sheet enters the secondary transfer nip. This state corresponds to a time T1 in FIG. 8. Subsequently, when the first cam 310 and the second cam 311 arrive at the cam position A as illustrated in FIG. 7, rotation of both the first cam 310 and the second cam 311 is stopped. This state corresponds to a time T2 in FIG. 8.

That is, when performing transfer with the DC bias, the first cam 310 and the second cam 311 push down the secondary transfer roller 24, thereby forming the space $X_A$ between the secondary transfer roller 24 and the intermediate transfer belt 10. With this configuration, during the transfer with the DC bias, even when a relatively thick recording medium enters the secondary transfer nip, a significant load fluctuation does not occur relative to the intermediate transfer belt 10 and the secondary transfer roller 24.

A desired size of the space $X_A$ between the secondary transfer roller 24 and the intermediate transfer belt 10 is in a range from approximately 0.1 mm to 2 mm. However, the size of the space $X_A$ is not limited thereto.

On the contrary, if the recording medium P is fed to the secondary transfer nip while the secondary transfer roller 24 is pushed down, a transfer pressure is not sufficient, resulting in degradation of transferability of the toner image. In particular, the transfer rate drops significantly when the surface of the recording medium P is not smooth.

In view of the above, according to the present illustrative embodiment, after the recording medium P enters the secondary transfer nip, the first cam 310 and the second cam 311 are rotated in an opposite direction indicated by arrow D4 (in a counterclockwise direction in FIG. 7). This state corresponds to a time T3 in FIG. 8. While a top margin at the leading end of the recording medium P passes through the secondary transfer nip, the first cam 310 and the second cam 311 are moved to the cam position C. Upon arrival of the first cam 310 and the second cam 311 at the cam position C, rotation thereof is stopped. This state corresponds to a time T4 in FIG. 8. It is to be noted that during image transfer, the first cam 310 and the second cam 311 remain situated at the cam position C.

Subsequently, after the toner image is transferred from the intermediate transfer belt 10 onto the recording medium P, the first cam 310 and the second cam 311 are rotated forward before the trailing edge of the recording medium P exits the secondary transfer nip. This state corresponds to a time T5 in FIG. 8. Subsequently, the first cam 310 and the second cam 311 are moved from the cam position C to the cam position A, and the rotation of the first cam 310 and the second cam 311 is stopped. This state corresponds to a time T6 in FIG. 8.

With this configuration, the first cam 310 and the second cam 311 are stopped at the cam position A, thereby separating the intermediate transfer belt 10 and the secondary transfer roller 24 from each other to form the space $X_A$ in preparation for the trailing edge of the recording medium P to exit the secondary transfer nip. Accordingly, when the recording medium P exits the secondary transfer nip, a significant load fluctuation does not occur relative to the intermediate transfer belt 10 and the secondary transfer roller 24. After that, the first cam 310 and the second cam 311 remain situated at the cam position A, and the next transfer with the DC bias is performed on the successive sheet of the recording medium P in a similar manner.

Figure 9:
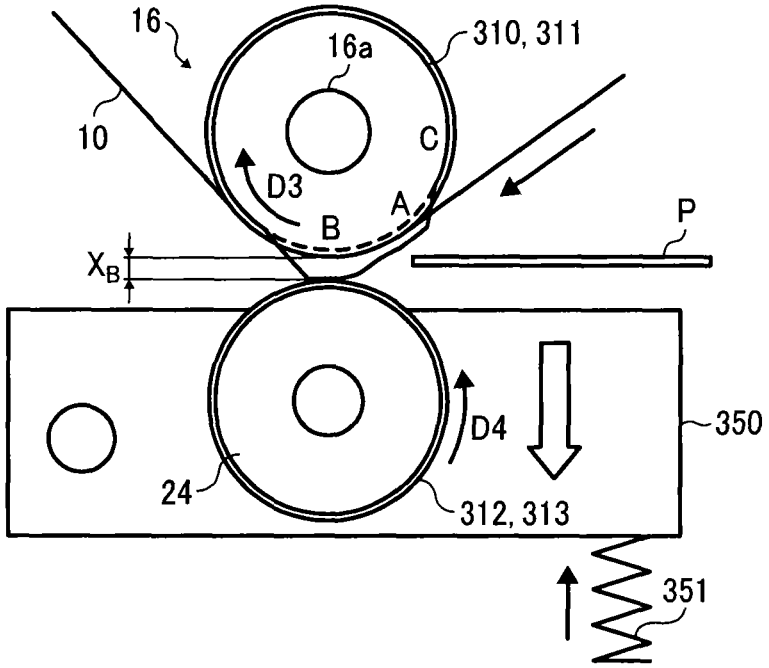
FIG. 9 is a schematic diagram illustrating the secondary transfer nip before the recording medium advances to the secondary transfer nip during transfer process using the superimposed bias as the secondary transfer bias.
Figure 10:
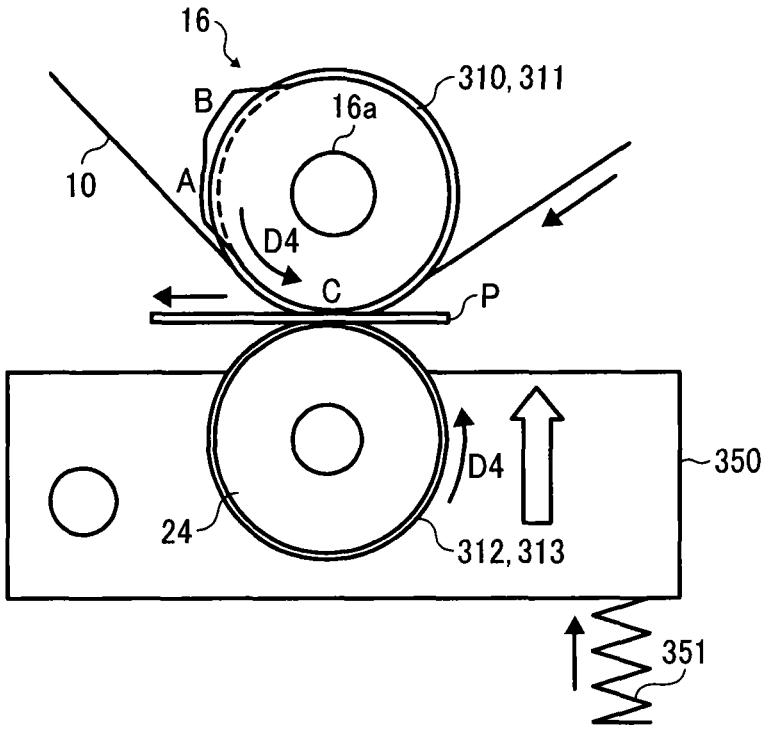
FIG. 10 is a schematic diagram illustrating the secondary transfer nip after the recording medium enters the secondary transfer nip during transfer process using the superimposed bias as the secondary transfer bias.
Figure 11:
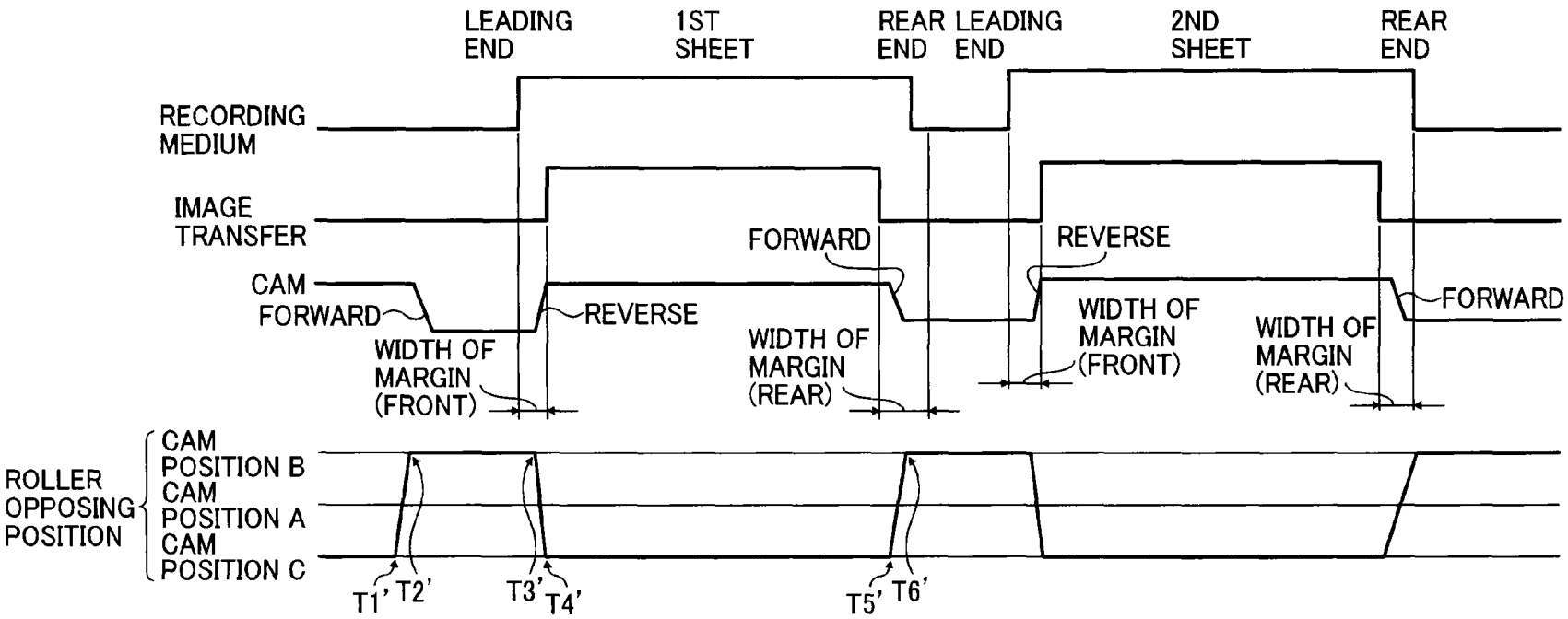
FIG. 11 is a timing diagram of rotation of the cams during transfer process using the superimposed bias as the secondary transfer bias.

FIG. 9 is a schematic diagram illustrating the secondary transfer nip before the recording medium P advances to the secondary transfer nip during transfer process using a superimposed bias as the secondary transfer bias. FIG. 10 is a schematic diagram illustrating the secondary transfer nip after the recording medium P enters the secondary transfer nip during transfer process using the superimposed bias as the secondary transfer bias. FIG. 11 is a timing diagram of rotation of the first cam 310 and the second cam 311 during transfer process using the superimposed bias as the secondary transfer bias.

With reference to FIGS. 9 through 11, a description is provided of movement of the intermediate transfer belt 10 and the secondary transfer roller 24 when performing superimposed bias transfer using the superimposed bias as the secondary transfer bias.

As shown in FIG. 9, when the first cam 310 and the second cam 311 are situated at the cam position B, the first cam 310 and the second cam 311 contact the first idler roller 312 and the second idler roller 313, respectively, thereby separating the intermediate transfer belt 10 and the secondary transfer roller 24 from each other to form a space $X_B$ therebetween.

A desired size of the space $X_B$ between the secondary transfer roller 24 and the intermediate transfer belt 10 is in a range from approximately 2 mm to 10 mm. However, the size of the space $X_B$ is not limited thereto. However, if the space $X_B$ is too small, electrical discharge occurs from the secondary-transfer opposed roller 16 to the secondary transfer roller 24, thereby hindering a desired rising of voltage.

As shown in FIG. 10, when the first cam 310 and the second cam 311 are situated at the cam position C, the first cam 310 and the second cam 311 do not contact the first idler roller 312 and the second idler roller 313 so that the intermediate transfer belt 10 and the secondary transfer roller 24 contact.

According to the present illustrative embodiment, when performing transfer with a superimposed transfer bias, first, the first cam 310 and the second cam 311 situated at the cam position B are rotated forward in the direction of arrow D3 (in the clockwise direction in FIG. 9) before the first sheet enters the secondary transfer nip. This state corresponds to a time T1' in FIG. 11. Subsequently, when the first cam 310 and the second cam 311 arrive at the cam position B as illustrated in FIG. 9, rotation of both the first cam 310 and the second cam 311 is stopped. This state corresponds to a time T2' in FIG. 11.

That is, when performing transfer with the superimposed transfer bias, the first cam 310 and the second cam 311 push down the secondary transfer roller 24, thereby forming the space $X_B$ between the secondary transfer roller 24 and the intermediate transfer belt 10. With this configuration, during the transfer with the superimposed bias, even when a relatively thick recording medium enters the secondary transfer nip, a significant load fluctuation does not occur relative to the intermediate transfer belt 10 and the secondary transfer roller 24.

According to the present illustrative embodiment, the space $X_B$ between the secondary transfer roller 24 and the intermediate transfer belt 10 upon transfer using the superimposed bias is larger than the space $X_A$ between the secondary transfer roller 24 and the intermediate transfer belt 10 upon transfer using the DC bias. The space $X_B$ provides a larger air layer between the secondary transfer roller 24 and the intermediate transfer belt 10 than the space $X_A$.

Due to the insulating effect of the air layer, the electrical discharge from the secondary-transfer opposed roller 16 to the secondary transfer roller 24 is difficult to occur, thereby accelerating the rise time of the voltage of the secondary-transfer opposed roller 16. With this configuration, a sufficient amount of transfer bias is attained at the leading end of an image upon transfer using the superimposed bias, hence preventing transfer failure such as a low image density at the leading end of the image.

According to the present illustrative embodiment, after the recording medium P enters the secondary transfer nip, the first cam 310 and the second cam 311 are rotated in the opposite direction indicated by arrow D4 (in the counterclockwise direction in FIG. 10). This state corresponds to a time T3' in FIG. 11. While the top margin at the leading end of the recording medium P passes through the secondary transfer nip, the first cam 310 and the second cam 311 are moved to the cam position C. Upon arrival of the first cam 310 and the second cam 311 at the cam position C, rotation of the first cam 310 and the second cam 311 is stopped. This state corresponds to a time T4' in FIG. 11. It is to be noted that during image transfer the first cam 310 and the second cam 311 remain situated at the cam position C'.

Subsequently, after the toner image is transferred from the intermediate transfer belt 10 onto the recording medium P, the first cam 310 and the second cam 311 are rotated forward before the trailing edge of the recording medium P exits the secondary transfer nip. This state corresponds to a time T5' in FIG. 11. Subsequently, the first cam 310 and the second cam 311 are moved from the cam position C to the cam position B, and the rotation of the first cam 310 and the second cam 311 is stopped. This state corresponds to a time T6' in FIG. 11.

With this configuration, the first cam 310 and the second cam 311 are stopped at the cam position B, thereby separating the intermediate transfer belt 10 and the secondary transfer roller 24 to form the space $X_B$ in preparation for the trailing edge of the recording medium P to exit the secondary transfer nip. Accordingly, when the recording medium P exits the secondary transfer nip, a significant load fluctuation does not occur relative to the intermediate transfer belt 10 and the secondary transfer roller 24. After that, the first cam 310 and the second cam 311 remain situated at the cam position B, and the next transfer with the superimposed bias is performed on the successive sheet of the recording medium P in a similar manner described above.

It is to be noted that because a recording medium with a coarse surface requires a higher secondary transfer voltage than regular paper upon secondary transfer, preferably, the intermediate transfer belt 10 and the secondary transfer roller 24 are separated for a longer period of time than the regular paper.

According to the present illustrative embodiment, upon transfer using the superimposed bias, the time at which the separated intermediate transfer belt 10 and the secondary transfer roller 24 start contacting is delayed, later than that upon transfer using the DC bias. Accordingly, the time during which the intermediate transfer belt 10 and the secondary transfer roller 24 are separated is made long. For example, when comparing FIG. 8 with FIG. 11, the time (the time T3' in FIG. 11) after the recording medium P enters the secondary transfer nip upon transfer using the superimposed bias is later than the time (the time T3 in FIG. 8) at which the intermediate transfer belt 10 and the secondary transfer roller 24 start contacting upon transfer using the DC bias.

With this configuration, the intermediate transfer belt 10 and the secondary transfer roller 24 are separated for a relatively long time upon transfer using the superimposed bias, thereby bringing reliably the voltage to a target level even under some disturbances.

TABLE 1 shows example combinations of a type of recording media, a transfer method, and a time at which the intermediate transfer belt 10 and the secondary transfer roller 24 start contacting. However, the combinations are not limited to this.

TABLE 1

| | REGULAR PAPER | EMBOSSED PAPER |
|---|---|---|
| TRANSFER METHOD | DC BIAS TRANSFER | SUPERIMPOSED BIAS TRANSFER |
| CONTACT START TIME | EARLY | LATE |

An example of regular paper in TABLE 1 includes "My Paper" (a trade name, manufactured by NBS Ricoh Co., Ltd. having a maximum surface roughness of approximately 163 μm. An example of textured paper or rough-surface paper in TABLE 1 is "LEATHAC 66" (a trade name, manufactured by TOKUSHU PAPER MFG. CO., LTD.) having a ream weight of 260 kg (a weight of 1000 sheets) and a maximum surface roughness of approximately 163 μm. Another example of textured paper includes "FC Japanese paper SAZANAMI" (a trade name, manufactured by NBS Ricoh Co., Ltd.) having a maximum surface roughness of approximately 82 p.m.

The cam position B of the first cam 310 and the second cam 311 has a larger rotation angle than the cam position A. As a result, it takes longer for the first cam 310 and the second cam 311 to reach the target angle. When moving the first cam 310 and the second cam 311 between the cam position C and the cam position B, the rotation speed of the cam drive motor 315 is increased, thereby rotating the first cam 310 and the second cam 311 fast. More specifically, the rotation speed of the cam drive motor 315 is faster than when moving the first cam 310 and the second cam 311 between the cam position A and the cam position C. With this configuration, the time during which the first cam 310 and the second cam 311 move from the cam position C to the cam position B can be the same as the time during which the first cam 310 and the second cam 311 move from the cam position C to the cam position A.

According to the present illustrative embodiment, the rotation speed of the cam drive motor 315 when moving the first cam 310 and the second cam 311 from the cam position C to the cam position A is approximately 1500 PPS (pulses per second) at max, for example. By contrast, the motor rotation speed of the cam drive motor 315 when moving the first cam 310 and the second cam 311 from the cam position C to the cam position B is in a range from approximately 1500 PPS to 2000 PPS at max, for example.

Although the embodiment of the present disclosure has been described above, the present disclosure is not limited to the foregoing embodiments, but a variety of modifications can naturally be made within the scope of the present disclosure.

[Aspect A]

A transfer device includes an image bearer, e.g., the intermediate transfer belt 10, to bear a toner image on a surface of the image bearer, a nip forming device, e.g., the secondary transfer roller 24 to contact the image bearer to form a transfer nip between the nip forming device and the image bearer, a transfer bias power source, e.g., the secondary transfer bias power source 309 including a direct current (DC) power source and an alternating current (AC) power source electrically connected to each other, to output a transfer bias including at least one of a DC bias and a superimposed bias in which a DC voltage and an AC voltage are superimposed to transfer a toner image borne on the image bearer onto a recording medium interposed in the transfer nip, a contact-and-separation device, e.g., the contact-and-separation device 600 to cause the image bearer and the nip forming device to contact and separate from each other, and a controller, e.g., the controller 400 to control the contact-and-separation device to increase a size of a space between the image bearer and the nip forming device upon transfer using the superimposed bias such that the space is larger than the space upon transfer using the DC bias.

According to Aspect A, the space between the image bearer and the nip forming device immediately before the recording medium enters the transfer nip upon transfer using the superimposed transfer bias is larger than that upon transfer using the DC transfer bias. With this configuration, a greater air layer is provided between the image bearer and the nip forming device, thereby enhancing the insulating effect of the air layer, and hence preventing electrical discharge in the transfer nip. As a result, the rise time of the voltage can be accelerated so that a sufficient amount of transfer bias is attained at the leading end of an image upon transfer using the superimposed bias, hence preventing transfer failure such as a low image density at the leading end of the image.

[Aspect B]

According to Aspect A, the time at which the image bearer and the nip forming device starts contacting upon transfer using the superimposed transfer bias is later than that upon transfer using the DC transfer bias.

As described above, the image bearer and the nip forming device are separated for a relatively long time, thereby bringing reliably the voltage to a target level even under some disturbances.

[Aspect C]

According to Aspect A or Aspect B, the transfer device includes a support roller including a rotary shaft disposed opposite to the nip forming device via the image bearer to rotatably support the image bearer to form the transfer nip. The nip forming device is a roller rotatable about a rotary shaft, and the image bearer is a belt. The contact-and-separation device includes a contact device, e.g., the first idler roller 312 and the second idler roller 313 disposed on at least one of the rotary shaft of the support roller and the rotary shaft of the nip forming device, an eccentric cam e.g., the first cam 310 and the second cam 311 disposed on the other one of the rotary shaft of the support roller and the rotary shaft of the nip forming device, a cam controller, e.g., the motor drive circuit 500 to rotate the eccentric cam to at least three different positions such as the cam position A, the cam position B, and the cam position C to change the size of the space between the image bearer and the nip forming device, and a biasing device, e.g., the coil spring 351 to bias the contact device in a direction in which the support roller and the nip forming device contact.

The cam controller rotates the eccentric cam to contact and move the contact device in a direction in which the image bearer and the nip forming device are separated from each other against a pressure from the biasing device, to form the space between the image bearer and the nip forming device. The cam controller rotates the eccentric cam to separate from the contact device while facing the contact device and move the contact device in a direction in which the image bearer and the nip forming device approach each other such that the support roller and the nip forming device contact each other via the image bearer with the pressure from the biasing device to form the transfer nip.

With this configuration, the eccentric cams for position adjustment can be controlled, thereby changing easily the size of the space between the image bearer and the nip forming device. Using a different size of the space upon transfer using the DC bias and upon transfer using the superimposed bias eliminates need for a large space (i.e., the space $X_B$) every time, hence preventing stress on the motor due to an increase in the torque and shock generated when the image bearer and the nip forming device contact again.

[Aspect D]

According to Aspect C, the rotation speed of the eccentric cams upon transfer using the superimposed bias is faster than that upon transfer using the DC bias. With this configuration, as described above, when the space between the image bearer and the nip forming device is relatively large, the time during which the image bearer and the nip forming device contact and separate from each other takes the same time as when the space therebetween is relatively small.

[Aspect E]

An image forming apparatus includes the transfer device according to any one of Aspects A through D to transfer the toner image formed on the image bearer onto the recording medium.

As described above, the space between the image bearer and the transfer device is optimized, thereby forming an image with good imaging quality.

According to an aspect of this disclosure, the present invention is employed in the image forming apparatus. The image forming apparatus includes, but is not limited to, an electrophotographic image forming apparatus, a copier, a printer, a facsimile machine, and a multi-functional system.

Furthermore, it is to be understood that elements and/or features of different illustrative embodiments may be combined with each other and/or substituted for each other within the scope of this disclosure and appended claims. In addition, the number of constituent elements, locations, shapes and so forth of the constituent elements are not limited to any of the structure for performing the methodology illustrated in the drawings.

Still further, any one of the above-described and other exemplary features of the present invention may be embodied in the form of an apparatus, method, or system.

For example, any of the aforementioned methods may be embodied in the form of a system or device, including, but not limited to, any of the structure for performing the methodology illustrated in the drawings.

Each of the functions of the described embodiments may be implemented by one or more processing circuits. A processing circuit includes a programmed processor, as a processor includes a circuitry. A processing circuit also includes devices such as an application specific integrated circuit (ASIC) and conventional circuit components arranged to perform the recited functions.

Example embodiments being thus described, it will be obvious that the same may be varied in many ways. Such exemplary variations are not to be regarded as a departure from the scope of the present invention, and all such modifications as would be obvious to one skilled in the art are intended to be included within the scope of the following claims.

What is claimed is:

1. A transfer device, comprising:

an image bearer to bear a toner image on a surface of the image bearer;

a nip forming device to approach the image bearer to form a transfer nip between the nip forming device and the image bearer;

a transfer bias power source including a direct current (DC) power source and an alternating current (AC) power source electrically connected to each other, to output a transfer bias including at least one of a DC bias and a superimposed bias in which a DC voltage and an AC voltage are superimposed to transfer the toner image borne on the image bearer onto a recording medium interposed between the nip forming device and the image bearer in the transfer nip;

an approach-and-separation device to cause the image bearer and the nip forming device to approach and separate from each other; and a controller to control the approach-and-separation device to increase a size of a space between the image bearer and the nip forming device at a start of a transfer using the superimposed bias such that the size of the space upon transfer, only when using the superimposed bias, is larger than a size of the space upon transfer using the DC bias.

2. The transfer device according to claim 1, wherein a time period from when a leading edge of the recording medium enters the nip until an image transfer using the superimposed bias is longer than a time period from when a leading edge of the recording medium enters the nip until an image transfer using the DC bias.

3. The transfer device according to claim 1, further comprising:

a support roller including a rotary shaft disposed opposite to the nip forming device via the image bearer to rotatably support the image bearer to form the transfer nip, wherein the nip forming device is a roller rotatable about a rotary shaft, and the image bearer is a belt, wherein the approach-and-separation device includes a contact device disposed on one of the rotary shaft of the support roller and the rotary shaft of the nip forming device, an eccentric cam disposed on the other of the rotary shaft of the support roller and the rotary shaft of the nip forming device, a cam controller to rotate the eccentric cam to at least three different positions to change the size of the space between the image bearer and the nip forming device, and a biasing device to bias the contact device in a direction in which the support roller and the nip forming member approach each other, wherein the cam controller rotates the eccentric cam to contact and move the contact device in a direction in which the image bearer and the nip forming device are separated from each other against a pressure from the biasing device, to form the space between the image bearer and the nip forming device, wherein the cam controller rotates the eccentric cam to separate from the contact device while facing the contact device and move the contact device in a direction in which the image bearer and the nip forming device approach each other such that the support roller and the nip forming device approach each other via the image bearer with the pressure from the biasing device to form the transfer nip.

4. The transfer device according to claim 3, wherein a rotation speed of the eccentric cam upon transfer using the superimposed bias is faster than a rotation speed of the eccentric cam upon transfer using the DC bias.

5. An image forming apparatus, comprising:

the transfer device of claim 1 to transfer the toner image formed on the image bearer onto the recording medium.

6. A transfer device, comprising:

an image bearer to bear a toner image on a surface of the image bearer;

a nip forming device to approach the image bearer to form a transfer nip between the nip forming device and the image bearer;

a transfer bias power source including a direct current (DC) power source and an alternating current (AC) power source electrically connected to each other, to output a transfer bias including at least one of a DC bias and a superimposed bias in which a DC voltage and an AC voltage are superimposed to transfer the toner image borne on the image bearer onto a recording medium interposed between the nip forming device and the image bearer in the transfer nip;

an approach-and-separation device to cause the image bearer and the nip forming device to approach and separate from each other; and a controller to control the approach-and-separation device to increase a size of a space between the image bearer and the nip forming device at a start of a transfer using the superimposed bias such that the size of the space upon transfer using the superimposed bias is larger than a size of the space upon transfer using the DC bias, wherein a time period from when a leading edge of the recording medium enters the nip until an image transfer starts using the superimposed bias is longer than a time period from when a leading edge of the recording medium enters the nip until an image transfer using the DC bias.

7. The transfer device according to claim 6, further comprising:

a support roller including a rotary shaft disposed opposite to the nip forming device via the image bearer to rotatably support the image bearer to form the transfer nip, wherein the nip forming device is a roller rotatable about a rotary shaft, and the image bearer is a belt, wherein the approach-and-separation device includes a contact device disposed on one of the rotary shaft of the support roller and the rotary shaft of the nip forming device, an eccentric cam disposed on the other of the rotary shaft of the support roller and the rotary shaft of the nip forming device, a cam controller to rotate the eccentric cam to at least three different positions to change the size of the space between the image bearer and the nip forming device, and a biasing device to bias the contact device in a direction in which the support roller and the nip forming member approach each other, wherein the cam controller rotates the eccentric cam to contact and move the contact device in a direction in which the image bearer and the nip forming device are separated from each other against a pressure from the biasing device, to form the space between the image bearer and the nip forming device, wherein the cam controller rotates the eccentric cam to separate from the contact device while facing the contact device and move the contact device in a direction in which the image bearer and the nip forming device approach each other such that the support roller and the nip forming device approach each other via the image bearer with the pressure from the biasing device to form the transfer nip.

8. The transfer device according to claim 7, wherein a rotation speed of the eccentric cam upon transfer using the superimposed bias is faster than a rotation speed of the eccentric cam upon transfer using the DC bias.

9. An image forming apparatus, comprising:

the transfer device of claim 6 to transfer the toner image formed on the image bearer onto the recording medium.

* * * * *